US005365869A

United States Patent [19]

Bulgarini

[11] Patent Number: 5,365,869

[45] Date of Patent: Nov. 22, 1994

[54] CATAMARAN FOR PASTIME, MODEL CONSTRUCTION OR RACING IN ANY COMPETITION RATING, WITH INDUCED HYDRODINAMIC STABILITY

[76] Inventor: Giovanni Bulgarini, Riviera S. Nicolò, 72, Venezia Lido, Italy

[21] Appl. No.: 117,022

[22] PCT Filed: Mar. 10, 1992

[86] PCT No.: PCT/IT92/00027

§ 371 Date: Sep. 8, 1993

§ 102(e) Date: Sep. 8, 1993

[87] PCT Pub. No.: WO92/15479

PCT Pub. Date: Sep. 17, 1992

[30] Foreign Application Priority Data

Mar. 11, 1991 [IT] Italy ..... VE91A000013

[51] Int. Cl.[5] ..... B63B 1/20

[52] U.S. Cl. ..... 114/61; 114/288; 114/290; 114/291

[58] Field of Search ..... 114/288, 290, 291, 61

[56] References Cited

U.S. PATENT DOCUMENTS

| | | | |
|---|---|---|---|
| 1,712,281 | 5/1929 | Royer | 114/288 |
| 2,969,760 | 1/1961 | Eddy | 114/291 |
| 3,148,652 | 9/1964 | Canazzi | 114/290 |
| 4,348,195 | 9/1982 | Lantz | 440/100 |

FOREIGN PATENT DOCUMENTS

| | | | |
|---|---|---|---|
| 0955804 | 1/1950 | France | 114/291 |

*Primary Examiner*—Sherman Basinger
*Attorney, Agent, or Firm*—Panitch Schwarze Jacobs & Nadel

[57] ABSTRACT

A catamaran for pastime, model construction or racing with induced hydrodynamic stability, having a hull with a board (1) and a pair of longitudinally extended semi-immersible appendages (2, 3; 8, 9; 13, 14; 24, 25) arranged parallel to each other symmetrically to the center-line of the hull, the respective bottoms of which, at the bow tips (**4, 5; 12, 12*a*; 21, 22; 32, 33**) of said appendages, have mutually opposite slopes, each slope being contrary to the slope of the respective aft rest of the bottom with respect to the median symmetry plane of the hull.

7 Claims, 3 Drawing Sheets

CATAMARAN FOR PASTIME, MODEL CONSTRUCTION OR RACING IN ANY COMPETITION RATING, WITH INDUCED HYDRODINAMIC STABILITY

FIELD OF THE INVENTION

The present invention concerns a catamaran with induced hydrodynamic stability.

BACKGROUND OF THE INVENTION

As it is known, racing catamarans or catamarans used for pleasure boating, usually called "two-points", or also the relevant models, have a forward configuration with two convergent bottoms or hulls, such as the bottoms of the monohull motorboats. This configuration has major drawbacks, especially during the races run in basins not perfectly calm.

In fact, it may happen that one of the two bottoms slips into the waves either due to a piloting mistake or falling down from the jumps the catamaran may make. In this way, it often occurs that, at best, there is just a spin-around of the catamaran, which at cruising speed can be very dangerous anyway, whereas, at worst, there may be the complete capsizing of the catamaran with the possible ejection of the pilot, with easily imaginable consequences.

U. S. Pat. No. 3,113,543 discloses a boat with two catamaran-like appendages having opposite slopes developing into a V-shaped hull at the boat end with the aim of obviating the difficulties of an inverted V-bottom boat, which is not suitable for high speeds in racing.

However, this solution could not be adopted in a real catamaran to overcome the above-mentioned problems due to the high speed experienced in racing.

The aim of the present invention is to eliminate or substantially reduce the above-mentioned drawbacks of known type catamarans by devising an induced hydrodynamic stability catamaran, which eliminates the possibility of spin-arounds or capsizings of the catamaran itself.

Within the scope of the mentioned aim, an object of the present invention is to obtain a catamaran maintaining the same driving and performance characteristics of known type catamarans.

Not last object of the present invention is to obtain a high reliability catamaran, fairly easy to build and at competitive costs.

SUMMARY OF THE INVENTION

The aim stated above, as well as the mentioned objects and others which will be clearer later on are achieved by an induced hydrodynamic stability catamaran including a hull formed by a pair of longitudinally extended semi-immersible appendages, arranged parallel to each other and symmetrically to the centre-line of the hull, the respective bottoms of which, at the forward ends of said appendages, have mutually opposite slopes, contrary to the slope of the aft rest of the bottom, with respect to the median symmetry plane of the hull.

BRIEF DESCRIPTION OF THE DRAWINGS

Further characteristics and advantages of the invention will be apparent from the description of some preferred, but not exclusive, embodiments of an induced hydrodynamic stability catamaran according to the invention, illustrated as indicative and non-limiting examples in the annexed drawings, wherein.

DETAILED DESCRIPTION OF THE INVENTION

Referring to the FIGS. from 1 to 5, an induced hydrodynamic stability catamaran includes a hull, schematically represented by a board 1 provided with a pair of longitudinally extended semi-immersible streamlined appendages 2 and 3 arranged along parallel sides of the board 1. The bottoms of the bow tips 4 and 5 of the semi-immersible appendages 2 and 3 have mutually opposite slopes, which are also contrary to the slope of the respective aft rest of the bottom.

Figure 1:
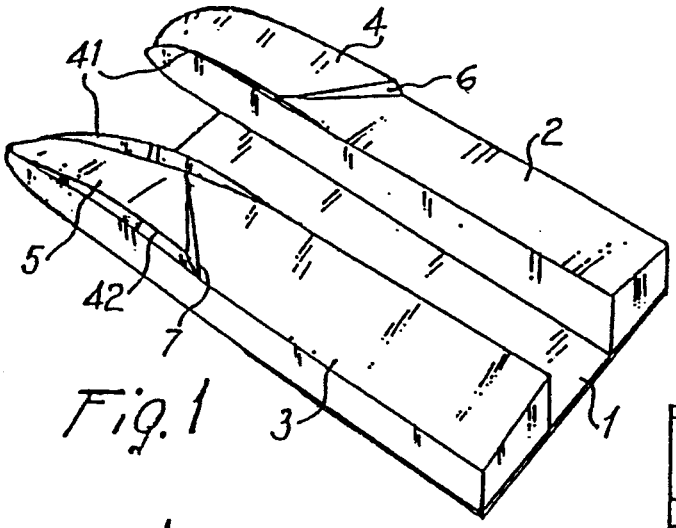
FIG. 1 is a perspective view from below of a first embodiment of a catamaran according to the invention.
Figure 2:
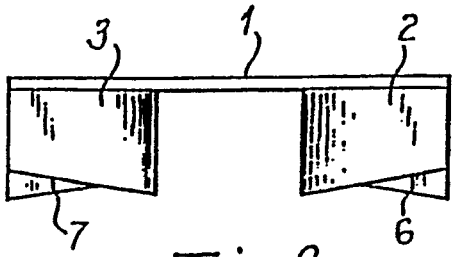
FIG. 2 is a front elevational view from the stern side of the catamaran of FIG. 1.
Figure 3:
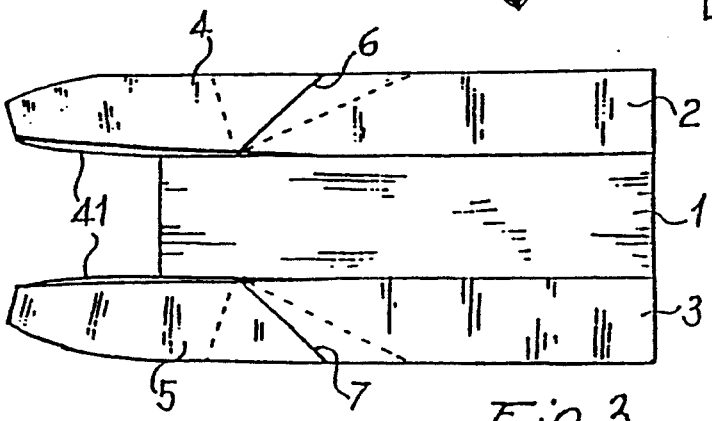
FIG. 3 is a plan view from below of the catamaran of FIG. 1.
Figure 4:
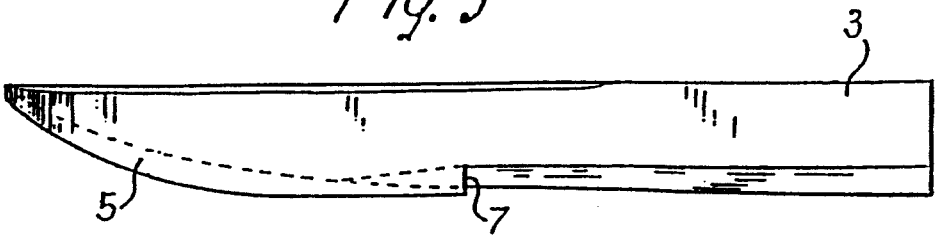
FIG. 4 is a side elevational view of the catamaran of FIG. 1.
Figure 5:
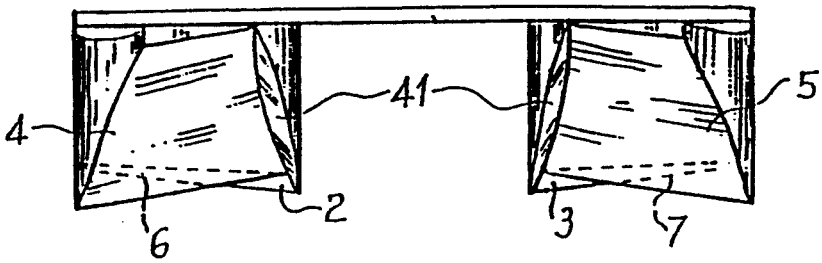
FIG. 5 is a front elevational view from the bow side of the catamaran of FIG. 1.

Each appendage 2 and 3 has at least one step, respectively identified by the reference numerals 6 and 7, which defines said bow tips 4 and 5 at the bottom slope variation, going from the stern to the bow of the hull. In a first embodiment, steps 6 and 7 form an inverted "V", going from stern to bow, as better illustrated in FIGS. 1 and 3.

In addition, at the inner edge of each appendage 2 and 3 there may be provided a runner 41 acting as a deflector to divert water out of the tunnel between the two appendages or boots, as well as preferably a bevelled portion 42 at the outer edge, with the purpose of reducing to a minimum the transverse skidding in case of falling down on one boot only.

Figure 6:
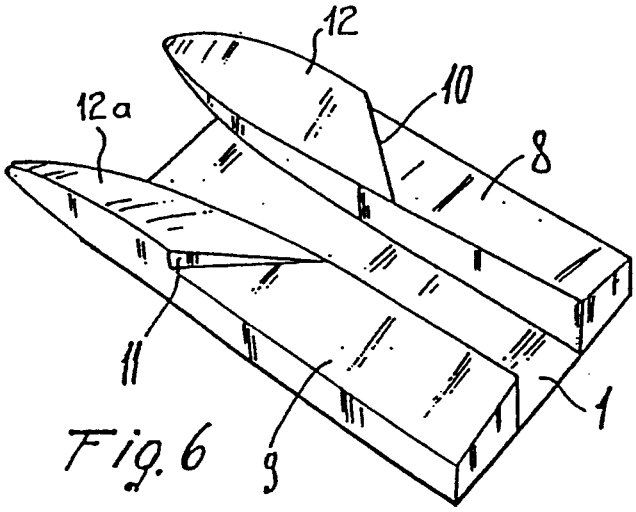
FIG. 6 is a perspective view from below of a second embodiment of a catamaran according to the invention.
Figure 7:
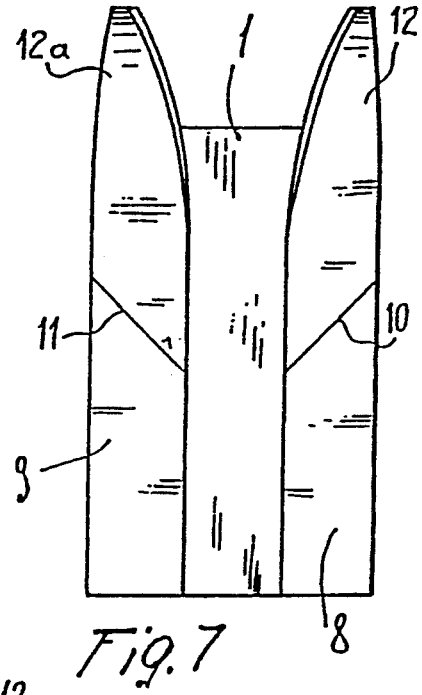
FIG. 7 is a plan view from below of the catamaran of FIG. 6.
Figure 8:
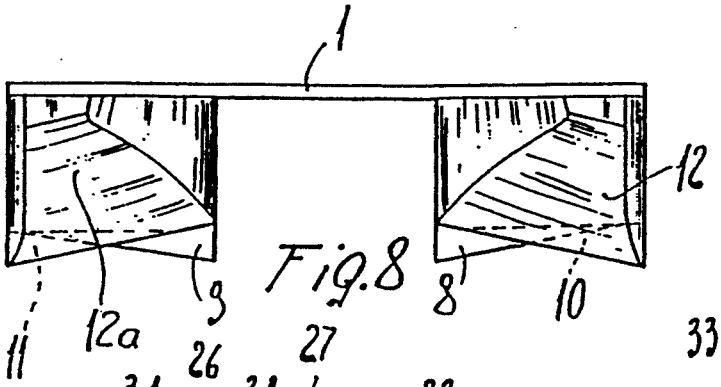
FIG. 8 is a front elevational view from the bow side of the catamaran of FIG. 6.

Referring to FIGS. from 6 to 8, in a second embodiment, having appendages 8 and 9, steps 10 and 11 and divergent bow portions 12 and 12*a*, the steps 10 and 11 form a "V", going from stern to bow, as better illustrated in FIGS. 6 and 7.

Referring to FIGS. from 11 to 13, in another embodiment, having appendages 13 and 14, steps 15, 16, 17, 18, 19 and 20 and divergent bow portions 21 and 22, the steps 15, 16, 17, 18, 19 and 20 form three "V's", going from stern to bow. At the steps 15, 16, 18 and 19 there are notches 23 which wedge themselves into both appendages 13 and 14.

Figure 9:
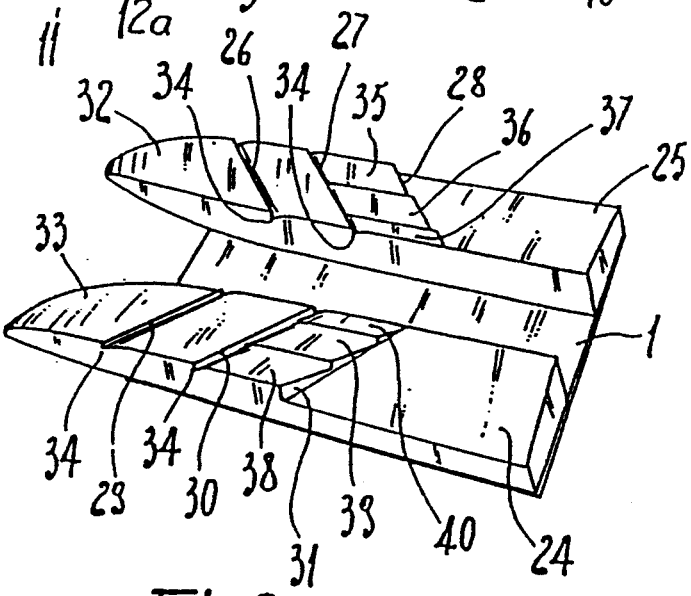
FIG. 9 is a perspective view from below of another embodiment of a catamaran according to the invention.
Figure 10:
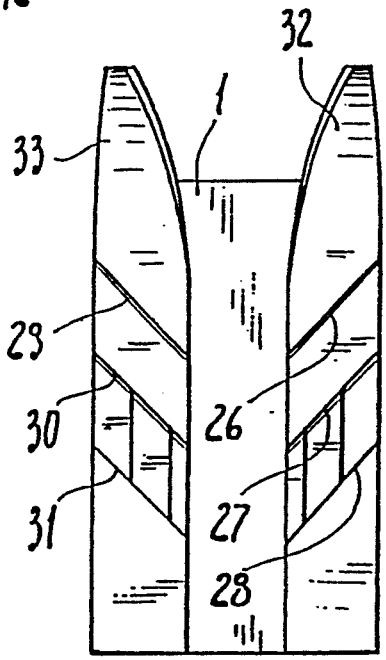
FIG. 10 is a plan view from below of the catamaran of FIG. 9.
Figure 11:
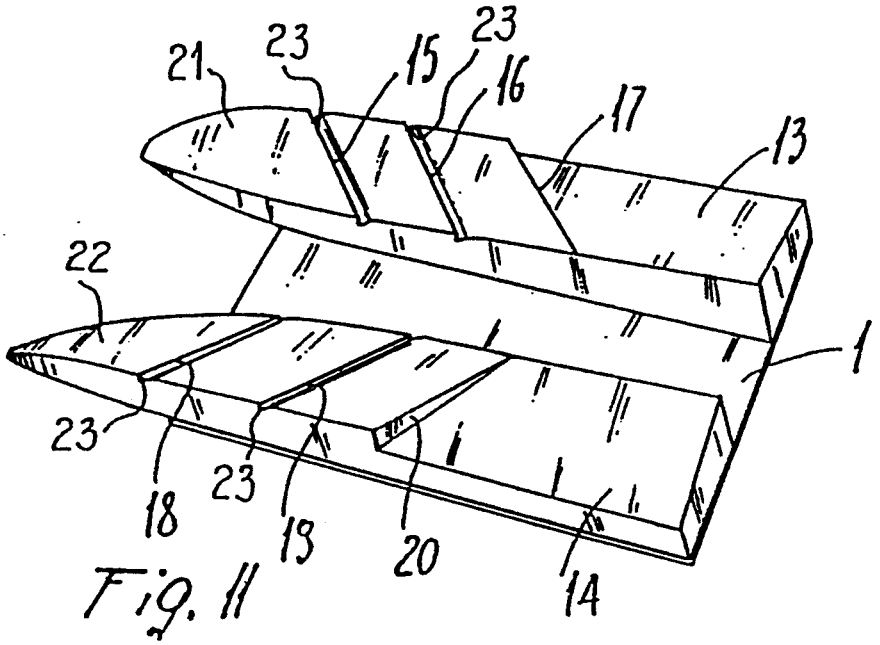
FIG. 11 is a perspective view from below of a further embodiment of a catamaran according to the invention.
Figure 12:
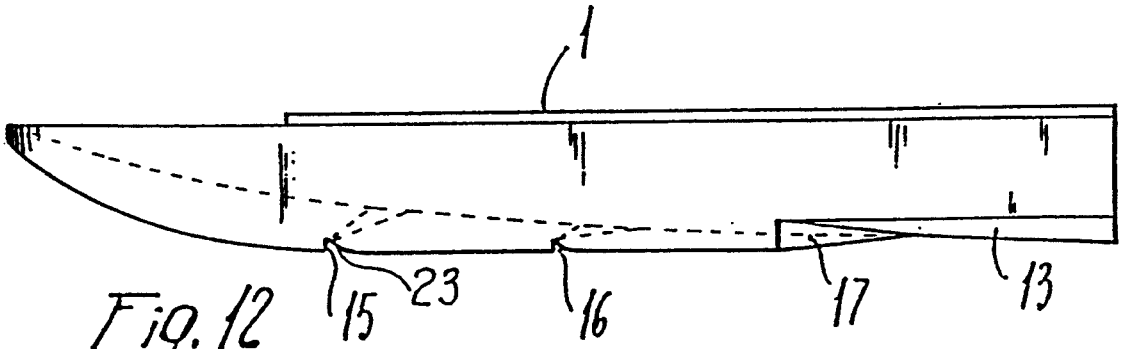
FIG. 12 is a side elevational view of the catamaran of FIG. 11.
Figure 13:
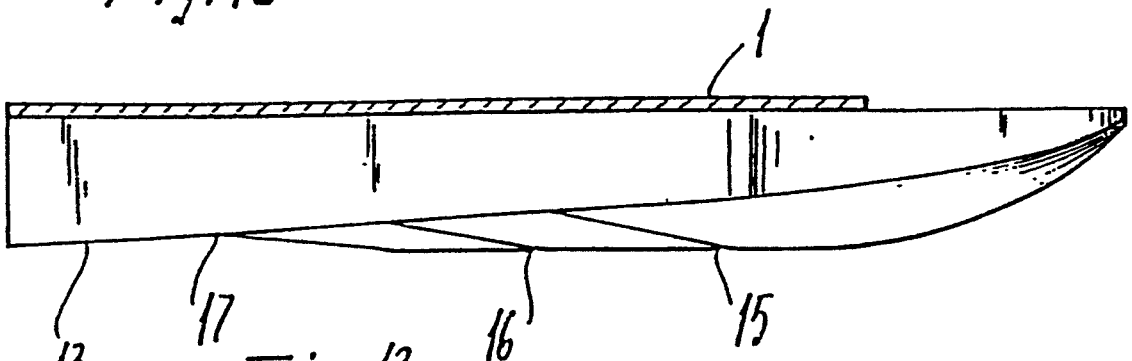
FIG. 13 is a side sectional elevational view along the axis of the catamaran of FIG. 11.

Referring to FIGS. 9 and 10, in an alternative embodiment, having appendages 24 and 25, steps 26, 27, 28, 29, 30 and 31 and divergent bow portions 32 and 33, the steps 26, 27, 28, 29, 30 and 31 form three "V's", going from stern to bow. At the steps 26, 27, 29 and 30 there are notches 34 which wedge themselves into both appendages 24 and 25, like in the embodiment of FIGS. 11–13.

Differently from said embodiment, in this model between the pairs of steps 27/28 and 30/31 there is provided a tier of steps, each formed by three steps respectively 35, 36 and 37; 38, 39 and 40, which slopes upwards from the bottom edge towards the longitudinal axis thereof.

Advantageously, the catamaran according to the invention, in its various embodiments, has the appendages bows with divergent slope bottoms, as stated above, which, in case of immersion into a wave, act as a rudder, thus putting the catamaran straight, either in the racing or pleasure boating type, and in the model construction type.

The invention as it has been conceived is susceptible of many modifications and variations all within the scope of the inventive concept. Moreover, all the details may be replaced by other technically equivalent elements.

In practice, the materials used as well as the dimensions may be any, according to the requirements.

I claim:

1. A catamaran for pastime, model construction or racing particularly suitable to high speeds, having a hull with a board and a pair of longitudinally extended semi-immersible appendages arranged along parallel sides of the board and symmetrically to a center-line of the hull, each of said appendages having a bow tip, a stern, an inner edge, and a bottom; and a runner on the inner edge of each appendage, said runner acting as a deflector;

wherein the respective bottoms at both bow tips of said appendages have mutually opposite slopes and the respective bottoms at both sterns of said appendages have mutually opposite slopes, the slope of each bow tip being contrary to the slope of the respective stern for each appendage, said contrary slopes defining a slope variation;

wherein each appendage has at least one step extending between the stern and the bow which defines said bow tips, said at least one step being symmetrically angled with respect to a median symmetry plane of the hull and having notches associated therewith, the notches being wedged into said appendages;

whereby said appendages provide an induced hydrodynamic stability to the catamaran.

2. A catamaran according to claim 1, characterized by the fact that said steps (6,7) form an inverted "V", proceeding from stern to bow.

3. A catamaran according to claim 1, characterized by the fact that said steps (10,11) form a "V" when proceeding from stern to bow.

4. A catamaran according to claim 1, characterized by the fact that said steps (15–20. 26–31) form at least two "V's", when proceeding from stern to bow.

5. A catamaran according to claim 4, characterized by the fact that one of said steps (28, 31) which is the nearest to the stern is formed with a degrading tier of steps (35,40) sloping down from an outer edge of the bottom towards a longitudinal axis thereof.

6. A catamaran according to claim 3, wherein each appendage has an edge on an outer edge thereof, said edge being bevelled further toward the inner edge.

7. A catamaran according to claim 1, wherein each appendage has an edge on an outer edge thereof, said edge being bevelled further toward the inner edge.

* * * * *